US005984696A

United States Patent [19]

Lee

[11] Patent Number: 5,984,696

[45] Date of Patent: Nov. 16, 1999

[54] HYBRID CONNECTOR AND RIGHT ANGLE FEMALE MEMBER AND MALE MEMBER THEREOF

[75] Inventor: Heung-Sik Lee, Kyunggi-Do, Rep. of Korea

[73] Assignee: Berg Technology, Inc., Reno, Nev.

[21] Appl. No.: 08/776,089

[22] PCT Filed: Jul. 31, 1995

[86] PCT No.: PCT/IB95/00678

§ 371 Date: Jan. 21, 1997

§ 102(e) Date: Jan. 21, 1997

[87] PCT Pub. No.: WO96/04695

PCT Pub. Date: Feb. 15, 1996

[30] Foreign Application Priority Data

Jul. 30, 1994 [KR] Rep. of Korea ..... 94-19431

[51] Int. Cl.[6] ..... H01R 9/09

[52] U.S. Cl. ..... 439/79; 439/947; 439/891

[58] Field of Search ..... 439/79, 947, 891, 439/908, 350, 89, 801

[56] References Cited

U.S. PATENT DOCUMENTS

| | | | |
|---|---|---|---|
| 4,384,758 | 5/1983 | Lee et al. | 439/801 |
| 4,530,551 | 7/1985 | Benasutti | 439/908 |
| 4,570,338 | 2/1986 | Ignatowicz | 439/801 |
| 5,055,055 | 10/1991 | Bakker | 439/947 |

FOREIGN PATENT DOCUMENTS

| | | | |
|---|---|---|---|
| 0 049 625 | 4/1982 | European Pat. Off. . | |
| 0 345 512 | 12/1989 | European Pat. Off. . | |
| 2-108283 | 9/1985 | Japan | 17/4 |
| 2-140782 | 4/1989 | Japan | 17/4 |

*Primary Examiner*—Neil Abrams
*Assistant Examiner*—T C Patel
*Attorney, Agent, or Firm*—Daniel J. Long; M. Richard Page

[57] ABSTRACT

The present invention relates, in general, to an improvement of a hybrid connector, and a right angle female member and male members therefor. A male member (11) comprises a projection pin (11*a*) formed to at one end and having a driver slot formed therein, and a flange (11*b*) and a screw hole (11*c*) formed at the other end, the flange having teeth It formed thereon. Also, the other male member (12) comprises a screw portion (12*a*) provided at one end lie and threadedly engaged with a screw hole (11*c*) of the male member (11), a projection pin (12*b*) provided at the other end and having a driver slot formed therein, and a flange (12*c*) provided between the screw portion (12*a*) and the projection pin (12*b*). A right angle female member (13) comprises a body portion, (13*a*) having six legs (13$a_1$), a rectangular rod shaped body (13$a_2$), and a plug portion receiving hole (13$a_3$) formed through the body portion, and a cylindrical hollow plug portion (13*b*) having a first end (13$b_1$) for fitting into the plug portion receving hole (13$a_3$), a second end (13$b_2$) in which a projection pin of a male member for a hybrid connector is fitted, and a flange portion (13$b_3$) formed between the first and second ends. A hybrid connector is constituted by a suitable combination of the first and second male members (11 and 12) and the right angle female member (13) and provides for improved electrical passages which will enable large quantities of current to flow through them.

4 Claims, 3 Drawing Sheets

HYBRID CONNECTOR AND RIGHT ANGLE FEMALE MEMBER AND MALE MEMBER THEREOF

BACKGROUND OF INVENTION

The present invention relates in general to a improvement of a hybrid connector, and a right angle female member and the male members therefor.

Generally, hybrid connectors are used as a connector for supplying power and data in electronic exchangers and data transmitting systems for telecommunication. In systems such as an electronic exchanger, a mother board and a daughter boards with various circuits and operating elements are provided, and a plurality of daughter boards are vertically mounted on the front face of the mother board, whereas the mother board has means for connecting the circuits on the mother board to the circuits on the rear face. In general, supplying power to a system such as an electronic exchanger is accomplished by conductive passages from a power supply to a daughter board, then from the daughter board to a mother board, and then from the mother board to another daughter board or another mother board. In order to supply power from the power supply to the mother board and the daughter board and therebetween, hybrid connectors in the form as shown in FIG. 1 are used.

The conventional type of hybrid connector 1 comprises a plug-to-plug coupler type male member 3 having a pair of projection pins mounted to project from opposite surfaces of the mother board, a pair of housing 4 to secure and support the male member 3 to the mother board 2, a right angle female member 6 secured onto the daughter board 5, a housing 7 for securing and supporting the right angle female member 6 onto the daughter board 5, a crimp-to-wire receptacle female member 8 receiving a wire connected to another mother board and fitted onto the male member 3, a housing 9 for supporting the female member 8. As a result of this construction, the supplies of power from the mother board 2 to the daughter board 5 and the other mother board are accomplished by a conductive passage extending from the printed circuitry conductor provided on a hole of the mother board 2 through a flange 3*a,* to the body of the male member 3 connected with the printed circuitry conductor, to the right angle female member 6 connected to one end of the male member 3, to the leg $\mathbf{6}a_1$ of the female member 6, and to the printed circuitry on the daughter board 5, and by another conductive passage extending to a printed circuitry on the other mother board through crimp-to-wire receptacle female member 8 connected to the other end of the male member 3, respectively. Each housing 4, 7 and 9 is constructed such that the housing 4 supporting the male member 3 is fitted with the other housings 7 and 8 to provide firm interconnections therebetween.

These conventional hybrid connectors contain following drawbacks:

(1) The plug-to-plug coupler type male member 3 is provided as a unitary body and protrudes from opposite surfaces of the mother board. In case where only one of the supplies of power is required from either the mother board 2 to the other mother board or from the mother board 2 to the daughter board 5, one of the protruded portions is unnecessary, thus resulting in dissipation of materials and loosing of space which can otherwise be used for mounting other parts.

(2) The male member 3 needs a pair of housings which must be mounted onto the mother board 2 and sometimes needs soldering.

(3) Although the electric connection between the male member 3 and the mother board 2 is accomplished by the printed circuitry conductors provided both on the generally cylindrical flange portion 3*a* which is positioned at the intermediate point of the male member 3 and on the holes of the mother board 2, this connecting method requires soldering in order to avoid a poor electrical connection between the flange and the printed circuit.

(4) As shows in detail in FIG. 1A, when the right angle female member 6 is assembled by press-fit of plug portion 6*b* machined from a cylindrical rod member into a body portion having four legs $\mathbf{6}a_1$, a plug receiving hole $\mathbf{6}a_2$ and a first end portion $\mathbf{6}b_1$ to be inserted therein should be machined with high accuracy since the plug receiving hole $\mathbf{6}a_2$ of the body portion 6*a* is a blind hole.

(5) Method for manufacturing the plug portion 6*b* to be fitted by the male member 3 comprises the complicated steps of forming the male member receiving hole $\mathbf{6}a_2$ by drilling and outer surface lathing the cylindrical rod member simultaneously, and forming and machining five stepped portions between a ring receiving portion $\mathbf{6}b_3$ to receive a ring 10 for securing the female member 6 to the housing 7 and the portion to be fitted into the plug receiving hole $\mathbf{6}a_2$.

(6) Although the right angle female member 6 has four legs $\mathbf{6}a_1$ for making an electrical connection between the daughter board 5 and the right angle female member 6, more legs are needed in order to make a more than four electrical circuitry. Therefore, it is an object of the present invention to solve the problems as mentioned above and to provide a male member for a hybrid connector which can be assembled so as to supply power from a mother board to another mother board or a daughter board, as desired.

Another object of the invention is to provide a male member and a right angle female member which can achieve a good electrical connection to the mother board and the daughter board.

Another object of the invention is to provide a right angle female member which can be manufactured more simply.

A further object of the invention is to provide a hybrid connector comprising the male member and the right angle female member as mentioned above.

SUMMARY OF THE INVENTION

Such objects of the present invention can be accomplished by providing a first male member comprising a projection pin formed at one end and having a driver slot formed therein and a flange and a screw hole formed at the other end, the flange having teeth formed thereon; a second male member comprising a screw portion provided at one end and threadedly engaged with the screw hole of the first male member, a projection pin provided at the other end and having a driver slot formed therein, and a flange provided between the screw portion and the projection pin; a right angle female member comprising a body portion having six legs, a rectangular rod shaped body, and a plug portion receiving hole formed through the body, and a cylindrical hollow plug portion having a first end for fitting into the plug portion receiving hole, a second end in which the projection pin of the male member for a hybrid connector is fitted, and a flange portion formed between first and second ends, respectively; and by providing a hybrid connector being adapted for combining and connecting the above members and a crimp-to-wire receptacle female member to which a outer power source is connected.

DETAILED DESCRIPTION OF THE INVENTION

The invention will be explained in more detail by way of an example with reference to the accompanying drawings.

Figure 2:
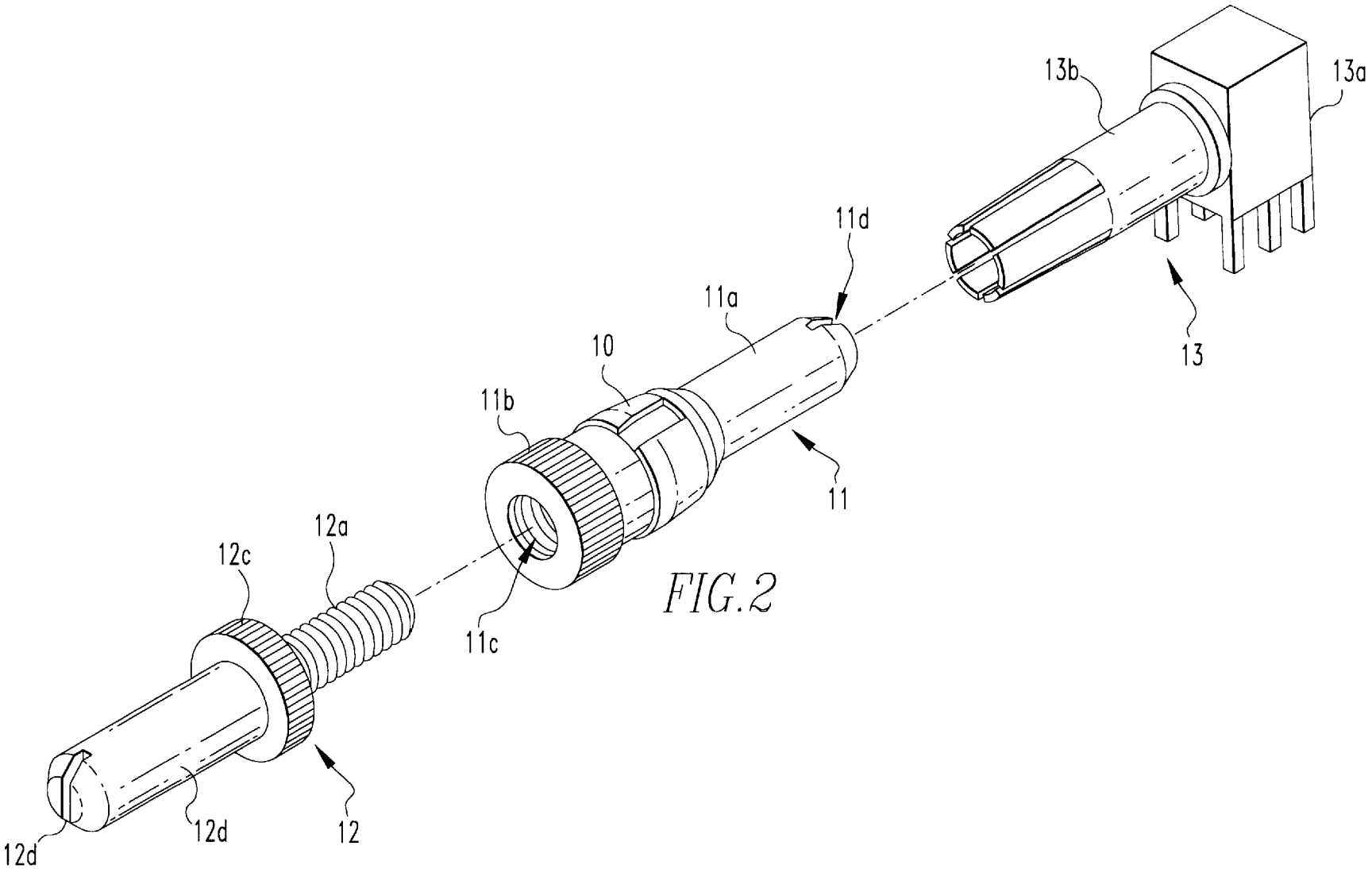
FIG. 2 is a perspective view of a right angle female member and a first and a second male member which form a hybrid connector according to the present invention.

FIG. 2 shows the first and second male members 11, 12 and a right angle female member 13 for a hybrid connector according to the present invention are shown.

Figure 1:
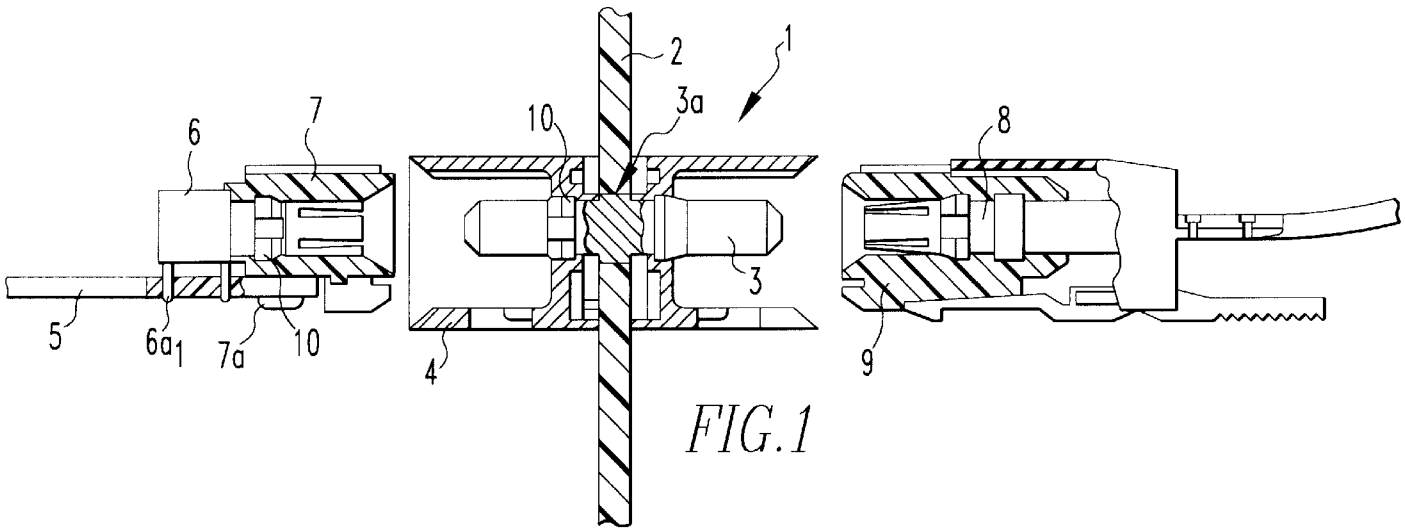
FIG. 1 is a sectional view of a conventional hybrid connector.
Figure 4:
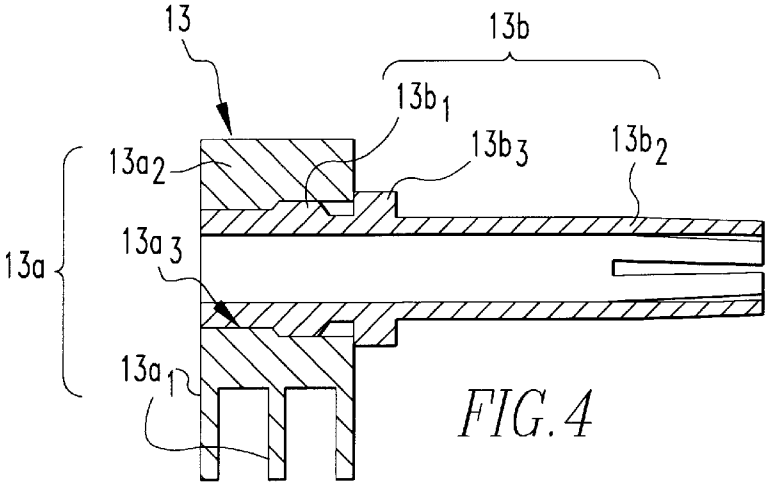
FIG. 4 is a sectional view of the right angle female member of the present invention.
Figure 3:
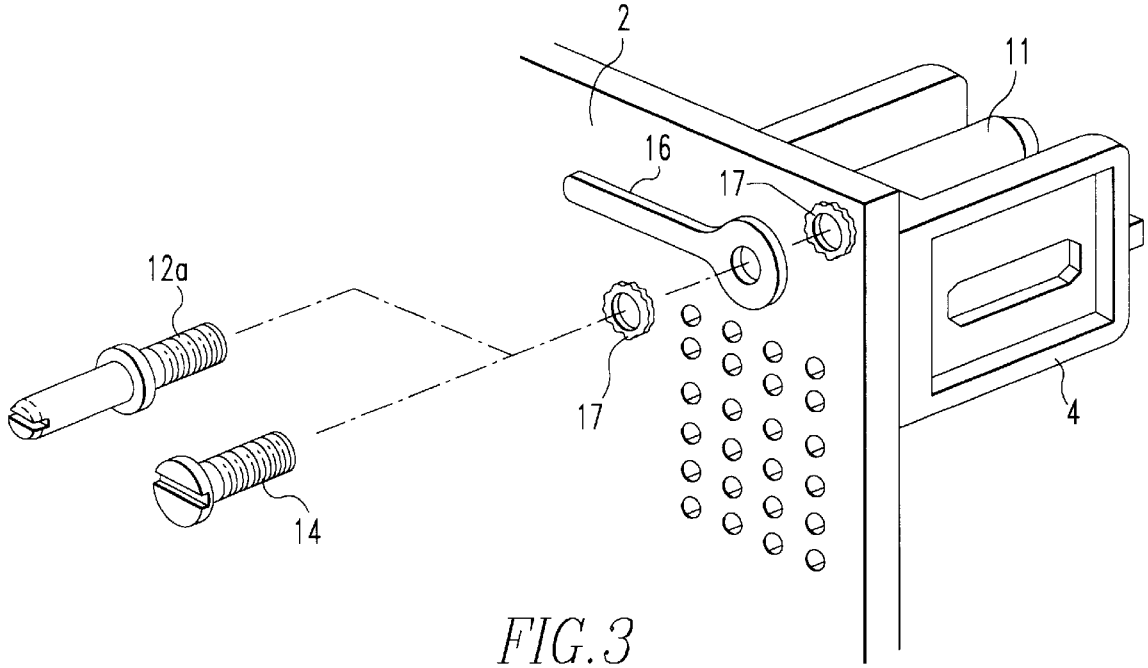
FIG. 3 is a perspective view showing how the mounting of the first and the second male member onto a mother board is made in order to illustrate the way of using the male members of the present invention.

The first male member 11 comprises a projection pin 11 a formed at one end which differs from the known male member 3 as shown in FIG. 1, and a flange 11*b* formed at the other end. The flange 11*b* has teeth formed thereon, so that if the flange is mounted into a mounting hole of a printed circuit board which is a mother board or a daughter board as shown in FIG. 4, the teeth are tightly fitted into and firmly engaged with a printed circuit conductor being provided within the mounting hole. This results in an improved electrical connection as compared with an electrical connection which is achieved by merely press-fitting the flange 3*a* of the conventional male member 3 as shown in FIG. 1 into the mounting hole of the printed circuit board. Also, the end of the first male member 11 which is provided with the flange 11*b,* is formed with a screw hole 11*c* so that a screw portion 12*a* of the second male member 12 or a screw 14 shown in FIG. 3 is threadedly engaged therein as will be explained below. As shown in FIG. 3, since the first male member 11 according to the invention is firmly engaged with the mounting hole of the mother board 2, which is a printed circuit board, by means of the flange 11*b* having teeth to obtain a good electrical connection, additional soldering is not needed for an electrical connection or fixation. The projection pin 11*a* of the first male member is formed with a driver slot 11*d* so that when using the screw 14 or when used together with the second male member 12, the first male member 11 can be fixed by a screw driver.

The second male member 12 comprises a screw portion 12*a* provided at one end and threadedly engaged with the screw hole 11*c* of the first male member 11, a projection pin 12*b* provided at the other end, and a flange 12*c* provided therebetween. The projection pin 12*b* of the second male member has a driver slot 12*d* formed therein to be used for the case when the second male member is threadedly engaged with the first male member.

With reference to FIG. 3, the state of the first and second male members 11,12 being mounted to the mother board 2 will be explained.

Firstly, if the flange 11*b* of the first male member 11 is tightly fitted into the mounting hole of the mother board 2 being provided with the printed circuit conductor, the teeth formed on the flange 11*b* and the printed circuit conductor can be engaged and connected with each other, thereby obtaining an improved electrical connection and a greater fixing force between the first male member 11 and the hole as compared with the flange 3*a* of the conventional male member 3 as shown in FIG. 1 which is merely pressfitted with the printed circuit conductor. After the first male member 11 is fixed to the mother board 2, as described above, a housing 4 is mounted to the first male member 11. The construction that the first male member 11 is mounted to the housing 4 by an O-ring is well-known and, therefore, a detailed explanation is omitted. In this state, if a washer 17 and the screw 14 are mounted to the first male member 11, the electrical connection between the printed circuit conductor and the first male member 11 as well as the fixing force of the first male member 11 to the mother board 2 are greatly enhanced since the mounting hole of the mother board 2 is commonly provided with a printed circuit conductor coating at the entire inner and the periphery thereof. While a very troublesome working such as soldering should be applied to the conventional male member 3 for obtaining a sufficient fixing and electrical connection to the mother board 2, as shown in FIG. 1, the fixing and electrical connection of the first male member, according to the invention, can be enhanced by simply threadedly engaging with the screw 14 to which the washer 17 is mounted.

If the right angle female member 13, which is mounted to the daughter board 5, is connected to the first male member 11 being mounted by the screw 14, as mentioned above, it is possible to supply power from the mother board 2 to the daughter board 5, whereas, if the first male member 11 is mounted to the opposite side of the mother board 2, it is possible to supply power from the mother board 2 through a conventional crimp-to-wire receptacle female member 8 to another mother board. Also, when a separate power supply is needed, a separate power circuit can be constituted by inserting and mounting a power bus bar 16 between the male member 11 and the screw 14.

In the above descriptions, a power passage from the mother board 2 to the daughter board 5 or from the daughter board 5 to the mother board 2 along with a separate power passage are described, but it is possible to supply power in two directions, from the mother board 2 to another mother board and the daughter board 5 simultaneously if the second male member 12, in place of the screw 14, is threadedly engaged with the first male member 11. Also, it is possible to provide a separate power passage by using a power bus bar 16. Therefore, the invention has an adaptability to provide three power passages, if necessary, by a suitable combination of the first and second male members 11, 12 and the power bus bar 16, according to the present invention. Also, the first male member 11 can be mounted at any place on the male member 2 or daughter board 5. Since the electrical connection ability and mounting ability are excellent, large quantities of current can flow through them.

Figure 1A:
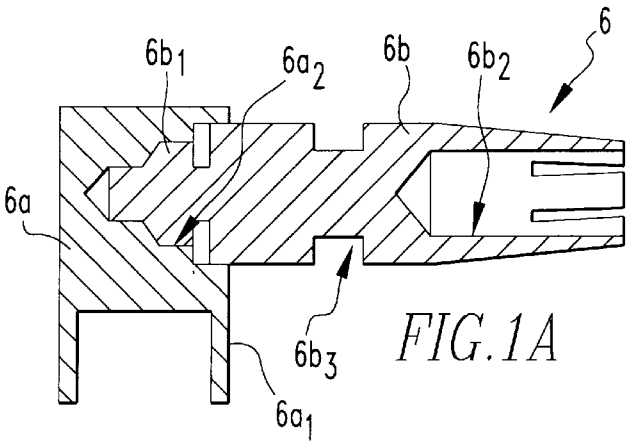
FIG. 1A is a sectional view of a right angle female member of the conventional hybrid connector.

As shown in a sectional view of FIG. 4, a right angle female member 13 comprises a body portion 13*a* mounted on the daughter board 5 which is a printed circuit board, a plug portion 13*b* having an end for fitting into and fixing to the body portion 13*a* and another end forming a plug in which a projection pin of the first male member 11 is fitted. The body portion 13*a* comprises six legs $\mathbf{13}a_1$ on the lower portion thereof penetrated in daughter board 5 and electrically connected with the printed circuit, a rectangular rod shaped body $\mathbf{13}a_2$, and a plug portion receiving hole $\mathbf{13}a_3$ in which one end of the plug portion 13*b* is mounted in the body portion. The hole 13$a_3$ is provided with a step for preventing the end of the plug portion 13*b* from projecting outwards from the hole when the end is press-fitted with the hole. The plug portion 13*b* is substantially shaped as a hollow sleeve, and comprises a first end 13$b_1$ for fitting into the plug portion receiving hole 13$a_3$ of the body portion 13*a,* a second end 13$b_2$ in which the projection pin of the first male member 11 is fitted, and a flange portion 13$b_3$ formed between said first and second ends. The plug portion 13*b,* according to the present invention, is not provided with a ring receiving portion for receiving a ring 10, which is different from that of the conventional right angle female member as shown in FIG. 1. However, if necessary, it is possible to provide a ring receiving portion for receiving the ring 10 on the right angle female member 13. In the case of the conventional right angle female member 6, as shown in FIG. 1A, the first end 6*b,* fitted into the body portion 6*a* is comprised of four portions, and the plug portion receiving hole 6$a_2$ of the body portion 6*a* and the first end 6$b_1$ should be machined with a high accuracy so that they can be easily assembled and fixed firmly. However, in the case of the right angle female member 13 of the present invention, since it is not necessary to machine the flange portion 13$b_3$ of the plug portion 13*b* separately, only four portions need to be machined. In the case of the right angle female member 13 of the present invention, two machining processes including one machining process for the ring receiving portion are omitted when compared with that of the conventional right angle female member.

Of course, if the right angle female member 13 of the present invention is provided with a ring receiving portion, only one machining process is less than the machining processes for the conventional right angle female member, especially, since the conventional right angle female member 6 is only assembled by press fitting, the body portion and the plug portion can be fixed in case the right angle female member 6 has a high machining accuracy. However, since the plug portion 13 of the invention penetrates through the body portion and is shaped like a hollow tube, the plug portion can be fixed more firmly to the body portion by expanding the diameter of the plug portion at the portion in which the plug portion 13*b* is fitted into the body portion, if necessary. Therefore, even if the right angle female member 13 of the present invention is not machined with a high accuracy as the convention one, the body portion 13*a* and the plug portion 13*b* can be fixed firmly together. In addition, the manufacturing process thereof can be reduced and easily made. Since the plug portion 13*b* of the right angle female member of the invention is shaped like a tube and fixed by penetrating it through the body portion 13*a,* the weight thereof is light when compared with the conventional right angle female member 6 of which only the male member receiving hole 6$b_2$ is shaped like a tube. Therefore, the present invention contributes by reducing the weight of the system.

It is understood that the connection features and the mounting positions of the male members 11 and 12 and the right angle female member 13 for a hybrid connector of the present invention, as described in the above, can vary in accordance with the constitutions and objects of a system, such as an electronic exchanger and etc. That is, since the projection pin size of both male members 11 and 12 are the same they can be connected with any one of the crimp-o-wire receptacle female member 8 and the right angle female member 13. Also, the male members 11 ard 12 and the right angle female member 13 can be mounted on any one of the mother board 2 and the daughter board 5.

What is claimed is:

1. A male member for a hybrid connector used for supplying a system power to a printed circuit board, comprising:

a projection pin (11*a*) having a tip formed at one end and having a driver slot formed in said tip, the driver slot is adapted to facilitate insertion of male into the printed circuit board; and a flange (11*b*) and a screw hole (11*c*) formed at the other end, the flange having teeth formed thereon, whereby no solder is required to attach the connector to the Printed circuit board.

2. A male member used in combination with the male member according to claim 1, comprising;

a screw portion (12*a*) provided at one end and threadedly engaged and in electrical contact with a screw hole (11*c*) in the male member (11);

a projection pin (12*b*) provided at the other end and having a driver slot formed therein; and a flange (12*c*) provided between said screw portion (12*a*) and said projection pin (12*b*).

3. A right angle female member for a hybrid connector used for supplying a system power to a printed circuit board, comprising;

a body portion (13*a*) having six legs (13$a_1$), a rectangular rod shaped body (13$a_2$) and a plug portion receiving hole (13$a_3$) formed through said body; and a tubular cylindrical hollow plug portion (13*b*) having a first end (13$b_1$) for fitting into said plug portion receiving hole (13$a_3$), a second end (13$b_2$) in which a projection pin of a male member for a hybrid connector is fitted, and a flange portion (13$b_3$) formed between said first and second ends.

4. A hybrid connector used for supplying a system power to a printed circuit board, comprising;

a male member (11) comprising a projection pin (11*a*) formed at one end and having a driver slot formed therein, and a flange (11*b*) and a screw hole (11*c*) formed at the other end, the flange having teeth formed thereon, whereby no solder is required to attach the connector to the solder board;

a male member (12) comprising a screw portion (12*a*) provided at one end and threadedly engaged and in electrical contact with a screw hole (11*c*) of the male member (11), a projection pin (12*b*) provided at the other end and having a driver slot formed therein, and a flange (12*c*) provided between said screw portion (12*a*) and said projection pin (12*b*); and a right angle female member (13) comprising a body portion (13*a*) having six legs (13$a_1$), a rectangular rod shaped body (13$a_2$), and a plug portion receiving hole (13$a_3$) formed through said body, and a tubular cylindrical hollow plug portion (13*b*) having a first end (13*b*) for fitting into said plug portion receiving hole (13$a_3$), a second end (13$b_2$) in which the projection pin of the male member for a hybrid connector is fitted, and a flange portion (13$b_3$) formed between said first and second ends.

* * * * *